US007298070B2

(12) United States Patent
Kanao

(10) Patent No.: US 7,298,070 B2
(45) Date of Patent: Nov. 20, 2007

(54) COMPACT STRUCTURE OF SPARK PLUG DESIGNED TO ENSURE DESIRED HEAT RANGE

(75) Inventor: Keiji Kanao, Aichi-ken (JP)

(73) Assignee: Denso Corporation, Kariya, Aichi-Pref (JP)

( * ) Notice: Subject to any disclaimer, the term of this patent is extended or adjusted under 35 U.S.C. 154(b) by 10 days.

(21) Appl. No.: 11/288,398

(22) Filed: Nov. 29, 2005

(65) Prior Publication Data

US 2006/0113883 A1 Jun. 1, 2006

(30) Foreign Application Priority Data

Nov. 29, 2004 (JP) ..... 2004-344506

(51) Int. Cl.
*H01T 13/20* (2006.01)

(52) U.S. Cl. ..... 313/141; 313/118

(58) Field of Classification Search ..... 313/140–143, 313/118; 445/7

See application file for complete search history.

(56) References Cited

U.S. PATENT DOCUMENTS 7,164,225 B2 * 1/2007 Yoshimoto et al. ..... 313/141

FOREIGN PATENT DOCUMENTS

JP 5-13147 1/1993

* cited by examiner

*Primary Examiner*—Joseph Williams
(74) *Attorney, Agent, or Firm*—Nixon & Vanderhye P.C.

(57) ABSTRACT

A spark plug for an internal combustion engine is provided which has a center electrode made up of an oxidation resistant alloy-made portion and a thermal conductive metal-made portion. The oxidation resistant alloy-made portion occupies at least a top portion of the center electrode exposed outside a porcelain insulator. The thermal conductive metal-made portion is exposed to a portion of an outer periphery of the center electrode which faces a insulator mount portion of a spark-mounting shell through the porcelain insulator in a direction perpendicular to an axial direction of the center electrode, thereby facilitating transfer or dispersal of heat from the center electrode to the mounting shell through the porcelain insulator to ensure a desired heat range.

11 Claims, 6 Drawing Sheets

COMPACT STRUCTURE OF SPARK PLUG DESIGNED TO ENSURE DESIRED HEAT RANGE

CROSS REFERENCE TO RELATED DOCUMENT

The present application claims the benefit of Japanese Patent Application No. 2004-344506 filed on Nov. 29, 2004, the disclosure of which is incorporated herein by reference.

BACKGROUND OF THE INVENTION

1. Technical Field of the Invention

The present invention relates generally to a compact structure of a spark plug for internal combustion engines which may be employed in automotive vehicles, cogeneration systems, or gas feed pumps, and more particularly to such a spark plug designed to ensure a desired heat range.

2. Background Art

Spark plugs are usually used in internal combustion engines such as ones mounted in automotive vehicles. The output of the engine is increased or the fuel consumption rate is improved by increasing the diameter of intake valves or exhaust valves leading to an intake manifold or an exhaust manifold of the engine. The cooling system is also improved by increasing the size of a water jacket as needed. This requires the need for downsized spark plugs in which a thread formed on a mounting shell has a diameter of M12 or less, as specified in JIS. The downsizing of the spark plugs requires thinning the center electrode thereof.

Usually, the spark plugs are required to minimize the overheating of the tip of the center electrode to avoid the pre-ignition. To this end, Japanese Patent First Publication No. 5-13147 teaches use of a center electrode 9, as illustrated in FIG. 9, made up of a high thermal conductive Cu-made core 91 and a Ni-made outer layer 92 to improve the degree of transfer or dispersal of heat from the spark plug (i.e., the heat range).

The whole of the Cu-made core 91 is, however, disposed inside the Ni-made outer layer 92, thus resulting in a lack in transferring thermal energy from the outer surface of the center electrode to a porcelain insulator surrounding the center electrode in terms of improvement of the heat range of the spark plug.

The thinning of the center electrode 9 requires decreasing the diameter of the Cu-made core 91. Such decreasing results in a reduction in thermal conductivity of the center electrode, which leads to a decrease in the heat range of the spark plug. The thinning of the center electrode 9 may also be achieved by decreasing the thickness of the Ni-made outer layer 92, but however, Cu is higher in thermal expansion, thus causing the Cu-made core 91 to expand to do physical damage to the Ni-made outer layer 92 when the temperature of the center electrode 9 rises.

The improvement of the degree of dispersal of heat from the spark plugs is typically achieved by decreasing the length of a leg (also called a nose) of the porcelain insulator (i.e., the distance between the tip of the porcelain insulator and a portion of the porcelain insulator born by a mounting shell of the spark plug. This, however, encounters the drawback in that the antifouling ability of the spark plug degrades.

SUMMARY OF THE INVENTION

It is therefore a principal object of the invention to avoid the disadvantages of the prior art.

It is another object of the invention to provide a compact structure of a spark plug for internal combustion engines which is designed to ensure a desired heat range.

According to one aspect of the invention, there is provided a spark plug for internal combustion engines. The spark plug comprises: (a) a plug mounting shell equipped with a thread which is formed on an outer periphery thereof and has a diameter of M12 or less, the mounting shell having an insulator mount portion formed therein; (b) a porcelain insulator disposed inside the mounting shell so as to have a tip end protruding from the mounting shell, the porcelain insulator having a mount portion born on the insulator mount portion of the mounting shell; (c) a ground electrode; and (d) a center electrode defining a spark gap between itself and the ground electrode. The center electrode is retained inside the porcelain insulator so as to have a top portion exposed outside the porcelain insulator and includes an oxidation resistant alloy-made portion and a thermal conductive metal-made portion. The oxidation resistant alloy-made portion is made from material containing a main component of Ni and an additive of at least one of Cr and Al and occupies at least the top portion of the center electrode. The thermal conductive metal-made portion is made of one of Cu, Cu alloy, Ni, and a composite material containing at least two of Cu, Cu alloy, and Ni and exposed to a portion of an outer periphery of the center electrode which faces the insulator mount portion of the mounting shell through the porcelain insulator in a direction perpendicular to an axial direction of the center electrode. This facilitates the transfer or dispersal of heat, as transmitted from a combustion chamber of the engine to the center electrode, to the mounting shell through the porcelain insulator.

The structure of the spark plug also results in a shortened heat transmission path extending from the center electrode to the porcelain insulator, to the insulator mount portion, and to the mounting shell, thereby improving the degree of dispersal of heat from the center electrode. This permits the center electrode to be decreased in diameter, but ensures a desired heat range of the spark plug.

The oxidation resistant metal-made portion occupies at least the top portion of the center electrode, thus minimizing the oxidation corrosion of the center electrode to ensure the durability thereof.

In the preferred mode of the invention, the porcelain insulator has a base end opposite the tip end in a lengthwise direction thereof. The porcelain insulator has formed therein an electrode mount portion which bears the center electrode. The electrode mount portion is located closer to the base end than the insulator mount portion of the mounting shell.

The thermal conductive alloy-made portion is exposed to a portion of the outer periphery of the center electrode in a range extending from a portion of the center electrode located 5 mm to 10 mm away from a tip end of the top portion of the center electrode to a base end of the center electrode opposite the tip end in a lengthwise direction of the center electrode. This ensures a desired heat range of the spark plug and minimizes thermal expansion of the center electrode.

The electrode mount portion may alternatively be located closer to the tip end of the porcelain insulator than the insulator mount portion of the mounting shell. This minimizes the thermal expansion of the center electrode which results in a decrease in size of the spark gap.

The thermal conductive metal-made portion of the center electrode has a top end located 2 mm to 7 mm away from the tip end of the porcelain insulator. This ensures a desired heat range of the spark plug and a physical strength of the tip of the porcelain insulator.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
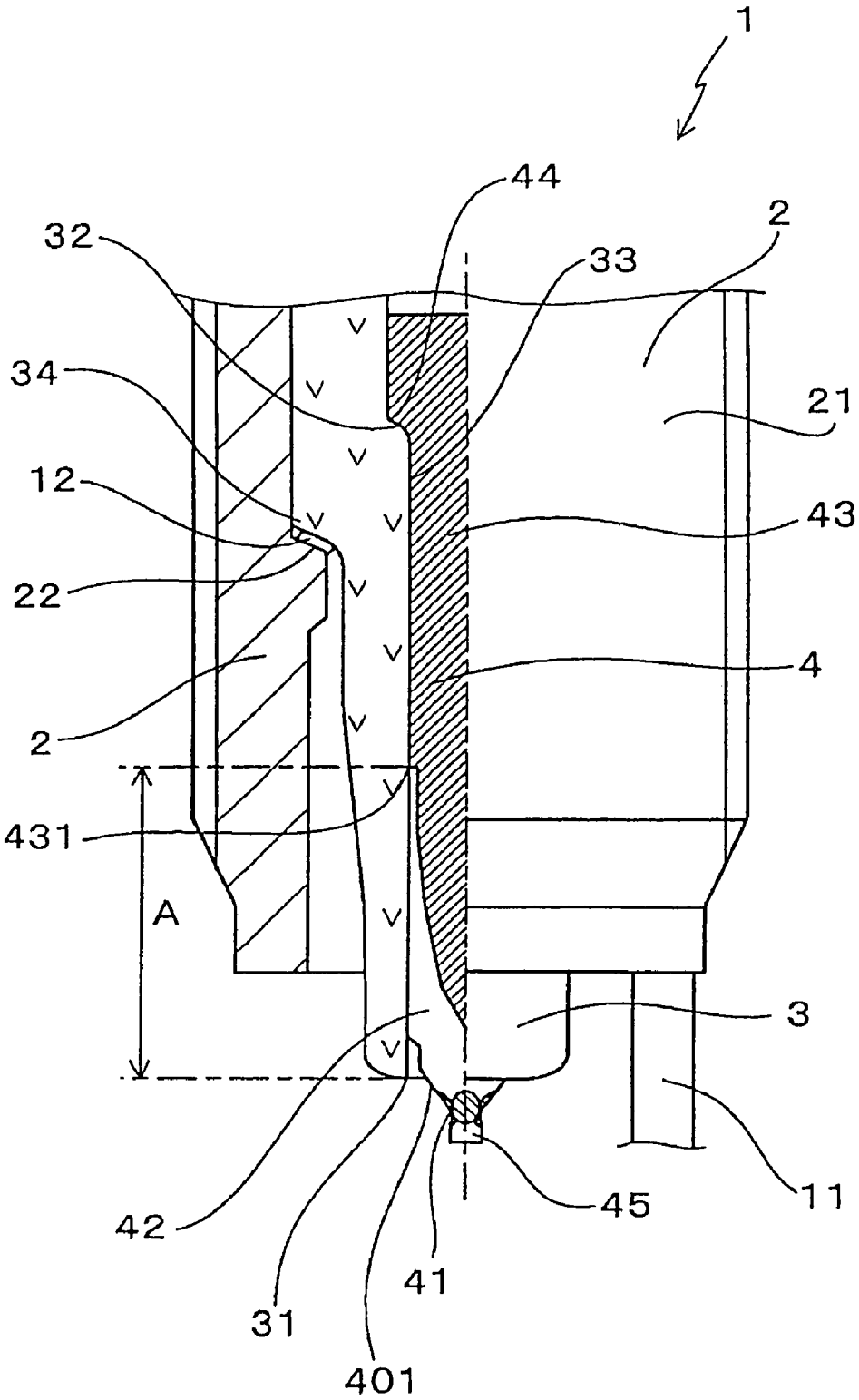
FIG. 1 is a partially longitudinal enlarged sectional view which shows a spark plug according to the first embodiment of the invention.
Figure 2:
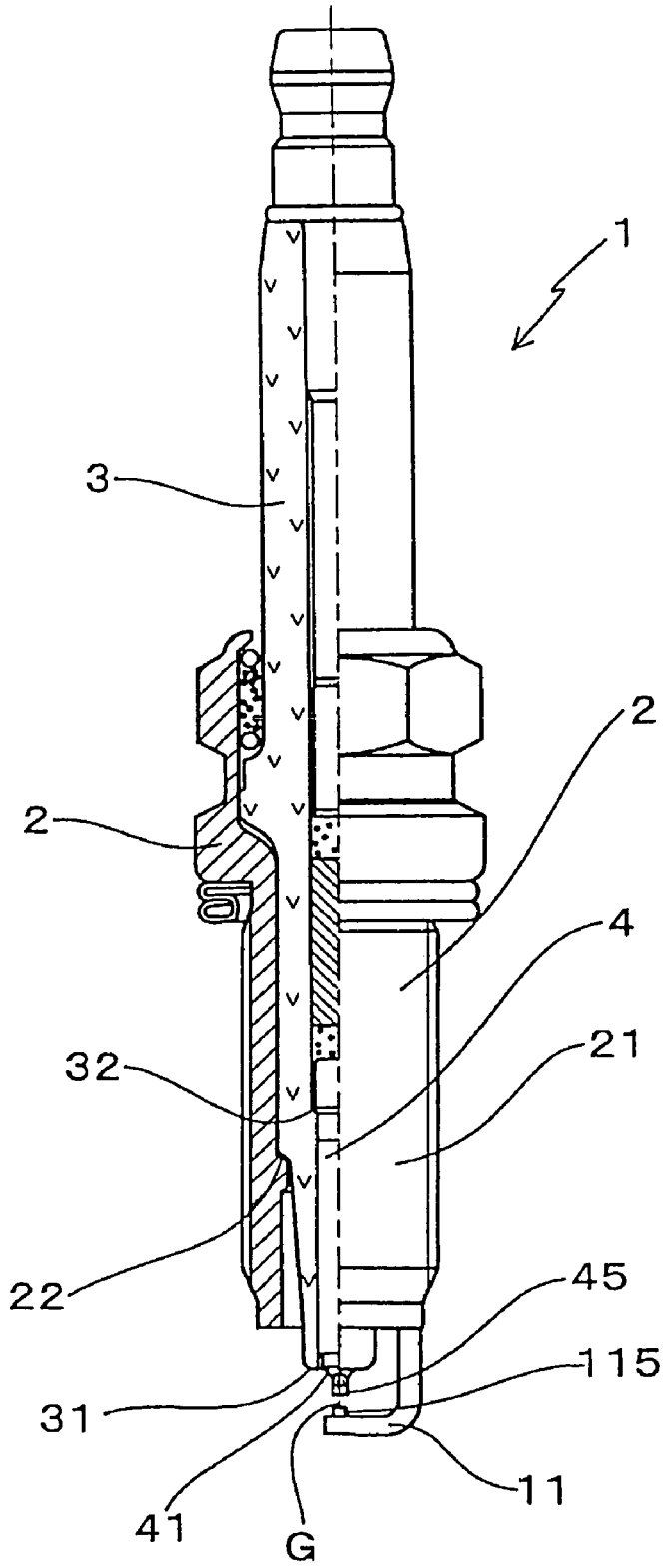
FIG. 2 is a partially longitudinal sectional view which shows a spark plug according to the first embodiment of the invention.

Referring now to the drawings, particularly to FIGS. 1 and 2, there is shown a spark plug 1 according to the first embodiment of the invention which may be employed in internal combustion engines.

The spark plug 1 includes a hollow cylindrical metallic plug-mounting shell 2, a porcelain insulator 3, a center electrode 4, and a ground electrode 11.

The plug-mounting shell 2 has formed on an outer periphery thereof a plug-installation thread 21 for installing the spark plug 1 in the engine. The thread 21 has a thread diameter of M12 (i.e., 12 mm) or less, as specified in JIS. The thread diameter is preferably greater than or equal to M8. The porcelain insulator 3 is retained inside the plug-mounting shell 2 to have a tip end 31 protruding from an end of the plug-mounting shell 2. The center electrode 4 is retained in the porcelain insulator 3 and has a tip 41 exposed outside the tip end 31 of the porcelain insulator 3. The ground electrode 11 is welded at a base end thereof to the plug-mounting shell 2 to define, as clearly shown in FIG. 2, a spark gap G between itself and the tip 41 of the center electrode 4.

Figure 3:
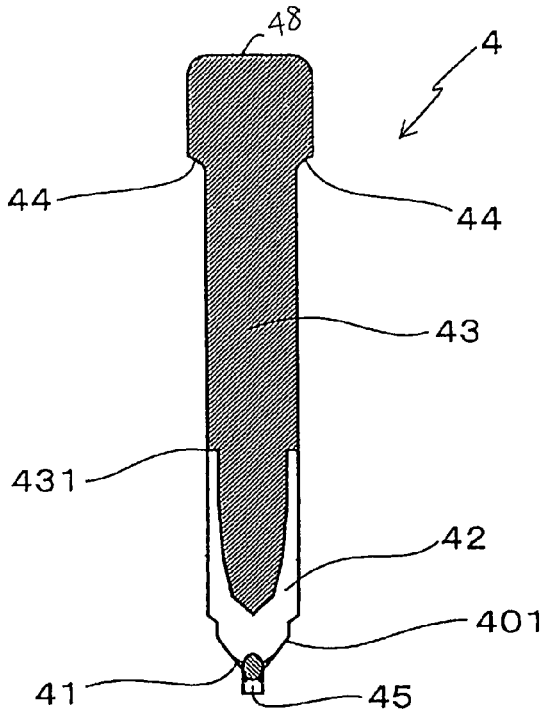
FIG. 3 is a longitudinal sectional view which shows an internal structure of a center electrode disposed in the spark plug of FIG. 2.

The center electrode 4 is, as illustrated in FIG. 3, made up of an oxidation resistant alloy-made portion 42 and a high thermal conductive metal-made portion 43. The oxidation resistant alloy-made portion 42 is made from material containing a main component of Ni (Nickel) or Fe (Iron) and an additive of at least one of Cr (Chrome) and Al (Aluminum). The material may contain 70% to 98% by weight of Ni or Fe. The additive may contain 1% to 20% by weight of Cr or 0.5% to 5% by weight of Al in terms of oxidation resistance or ease of machining the center electrode 4. The high thermal conductive alloy-made portion 43 is made from Cu (Copper), Cu alloy, Ni, or a composite material containing two or three of them.

Referring back to FIG. 1, the center electrode 4 has a portion 401 exposed outside the porcelain insulator 3 which is formed by at least a part of the oxidation resistant alloy-made portion 42. The high thermal conductive metal-made portion 43 forms an outer periphery of the center electrode 4 which at least faces an annular shoulder seat 22 of the plug-mounting shell 2, on which the porcelain insulator 3 is seated, in a radius direction of the center electrode 4.

The porcelain insulator 3 has formed on an inner periphery thereof an annular shoulder seat 32 which serves as a retainer to retain the center electrode 4 within the porcelain insulator 3. The annular shoulder seat 32 is located closer to a base portion (i.e., an upper portion, as viewed in the drawing) of the porcelain insulator 3 than the shoulder seat 22 of the plug-mounting shell 2.

The annular shoulder seat 32 of the porcelain insulator 3 serving to bear the center electrode 4 is formed on an inner wall of the porcelain insulator 3 and protrudes inside an axial bore 33 of the porcelain insulator 3. The center electrode 4 has an annular shoulder 44 formed on an outer periphery thereof which is seated on the shoulder seat 32 of the porcelain insulator 3.

The shoulder seat 22 serving to bear the porcelain insulator 3 is formed on an inner wall of the plug-mounting shell 2. The porcelain insulator 3 has formed on an outer periphery thereof an annular shoulder 34 which is seated on the shoulder seat 22 through an annular gasket 12.

The high thermal conductive metal-made portion 43 is exposed to a portion of the outer periphery of the center electrode 4 in a range extending from a portion of the center electrode 4 located 5 mm to 10 mm away from the tip end 31 to the base end 48 of the center electrode 4. Specifically, as clearly shown in FIG. 1, the axial distance A between the tip end 31 and an exposed top end 431 of the high thermal conductive metal-made portion 43 that forms an interface with the oxidation resistant alloy-made portion 42 on the outer surface of the center electrode 4 in the axial direction of the center electrode 4 is selected to lie within a range of 5 mm to 10 mm. The high thermal conductive metal-made portion 43 is made up of two portions: a top portion and a base portion. The top portion extends inside the oxidation resistant alloy-made portion 42. The base portion is exposed to the inner wall of the porcelain insulator 3 at the outer periphery of the center electrode 4 and extends from the exposed top end 431 to the base end 48 (i.e., the upper end, as viewed in FIG. 3) of the center electrode 4.

The center electrode 4 has a noble metal chip 45 welded to the tip thereof. The noble metal chip 45 is made of Ir metal, Ir alloy, Pt metal, or Pt alloy. Similarly, the ground electrode 11, as clearly shown in FIG. 2, has welded to the tip thereof a noble metal chip 115 facing the noble metal chip 45 through the spark gap G. The noble metal chip 115 is made of Ir metal, Ir alloy, Pt metal, or Pt alloy.

The oxidation resistant alloy-made portion 42 may be made of an INCONEL 600 (a registered trademark of Inco Alloys International) containing a main component Ni and an additive of 15% by weight of Cr. The high thermal conductive metal-made portion 43 may be made of a pure Cu.

The center electrode 4 has a diameter of 1.2 mm to 2.2 mm at a portion thereof facing the shoulder seat 22 of the plug-mounting shell 2 in the radius direction thereof.

The high thermal conductive metal-made portion 43 of the center electrode 4 has, as described above, the top portion which, as clearly shown in FIG. 3, extends from the exposed top end 431 toward the tip of the center electrode 4 within the oxidation resistant alloy-made portion 42 as a whole. The oxidation resistant alloy-made portion 42 may occupy at least the exposed portion 401 of the center electrode 4 other than the noble metal chip 45.

The above described structure of the spark plug 1 offers the following beneficial effects.

The center electrode 4 has the high thermal conductive metal-made portion 43 exposed to at least a portion of the porcelain insulator 3 facing the shoulder seat 22 of the plug-mounting shell 2 in the radius direction thereof at the outer surface of the center electrode 4. This facilitates transfer of heat, as transmitted from a combustion chamber of the internal combustion engine through the center electrode 4, to the porcelain insulator 3 and to the plug-mounting shell 2 for dissipating it.

During use of the spark plug 1, the center electrode 4 is subjected at the tip thereof to intense heat in the combustion chamber of the engine. Such heat is transmitted toward the base portion of the center electrode 4. Most of the heat is carried to the porcelain insulator 3 located around the outer periphery of the center electrode 4 and to the plug-mounting shell 2 through the shoulder seat 22 and dissipated outside the plug-mounting shell 2.

Specifically, the high thermal conductive metal-made portion 43 serves to have the thermal energy, as transmitted from the tip of the center electrode 4 (i.e., the oxidation resistant alloy-made portion 42), escape to the plug-mounting shell 2 along a short thermal conducive path extending from the outer wall of the center electrode 4 to the porcelain insulator 3 and to the plug-mounting shell 2 through the shoulder seat 22, thereby facilitating the heat transfer from the center electrode 4 to the plug-mounting shell 2 This enables the spark plug 1 to be reduced in diameter of the center electrode 4, but the heat range to be improved.

The center electrode 4 is exposed at the top portion thereof (i.e., the portion 401) directly to the intense heat in the combustion chamber of the engine. The top portion is formed or occupied by the oxidation resistant alloy-made portion 42, thus minimizing oxidation corrosion of the center electrode 4 to ensure the durability thereof.

The annular shoulder seat 32 of the porcelain insulator 3 on which the center electrode 4 is retained is located closer to the base end of the spark plug 1 than the shoulder seat 22 of the plug-mounting shell 2, thus permitting the nose of the porcelain insulator 3 to be increased in thickness. Specifically, the porcelain insulator 3 has a smaller outer diameter at the nose extending to the tip thereof from the shoulder seat 22 and a greater inner diameter at the other portion thereof extending to the base end thereof from the shoulder seat 22. In a range of such a greater inner diameter of the porcelain insulator 3, the center electrode 4 has a greater outer diameter. Therefore, forming the annular shoulder seat 32 closer to the base end of the porcelain insulator 3 than the shoulder seat 22 of the plug-mounting shell 2 allows a portion of the porcelain insulator 3 near the annular shoulder seat 32 to be increased in thickness.

The high thermal conductive metal-made portion 43 is, as described above, exposed to a portion of the outer periphery of the center electrode 4 which occupies a range extending from a portion of the center electrode 4 located 5 mm to 10 mm away from the tip end 31 to the base end 48 of the center electrode 4, thus ensuring a desired heat range of the spark plug 1 and minimizing the thermal expansion of the center electrode 4.

Figure 4:
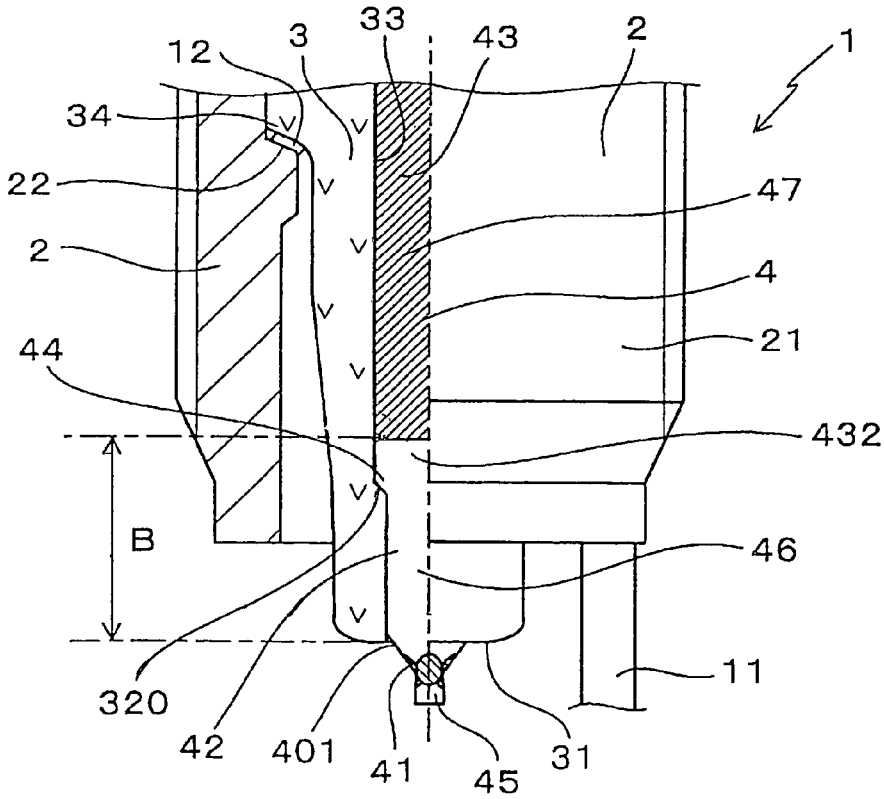
FIG. 4 is a partially longitudinal enlarged sectional view which shows a spark plug according to the second embodiment of the invention.

FIG. 4 shows the spark plug 1 according to the second embodiment of the invention in which the porcelain insulator 3 has an annular shoulder seat 320 located closer to the top thereof than the shoulder seat 22 of the plug-mounting shell 2.

The center electrode 4, like the first embodiment, consists of the high thermal conductive metal-made portion 43 and the oxidation resistant alloy-made portion 42. The high thermal conductive metal-made portion 43 has a top end 432 located 2 mm to 7 mm away from the tip end 31 of the porcelain insulator 3. Specifically, the axial distance B between the top end 432 of the high thermal conductive metal-made portion 43 and the tip end 31 of the porcelain insulator 3 lies within a range of 2 mm to 7 mm.

The annular shoulder seat 320 serving to bear the center electrode 4 is formed on the inner wall of the porcelain insulator 3 and protrudes inside the axial bore 33 of the porcelain insulator 3. The center electrode 4 has the annular shoulder 44 formed on the outer periphery thereof which is seated on the shoulder seat 32 of the porcelain insulator 3. The center electrode 4 is made up of a small-diameter portion 46 extending from the shoulder seat 320 to the tip thereof and a large-diameter portion 47 extending from the shoulder seat 320 to the base end thereof. The small-diameter portion may have a diameter of 0.8 mm to 1.4 mm. The large-diameter portion may have a diameter of 1.2 mm to 2.2 mm. Other arrangements are identical with those in the first embodiment, and explanation thereof in detail will be omitted here.

The structure of this embodiment serves to minimize the thermal expansion of the center electrode 4 which results in a decrease in the spark gap G. Most of the thermal expansion of the center electrode 4 results from the thermal expansion of the high thermal conductive metal-made portion 43 having a higher coefficient of thermal expansion. Thus, when the top end 432 of the high thermal conductive metal-made portion 43 is formed closer to the base end of the center electrode 4 than the shoulder seat 320 of the porcelain insulator 3, the oxidation resistant alloy-made portion 42 serves as a stopper to suppress the thermal expansion of the high thermal conductive metal-made portion 43 in a lengthwise direction thereof toward the tip 41, thus ensuring a desired size of the spark gap G.

The top end 432 of the high thermal conductive metal-made portion 43 is, as described above, located 2 mm to 7 mm away from the tip end 31 of the porcelain insulator 3, thereby ensuring a desired heat range of the spark plug 1 and a desired mechanical strength of the tip 31 of the porcelain insulator 31.

Figure 5:
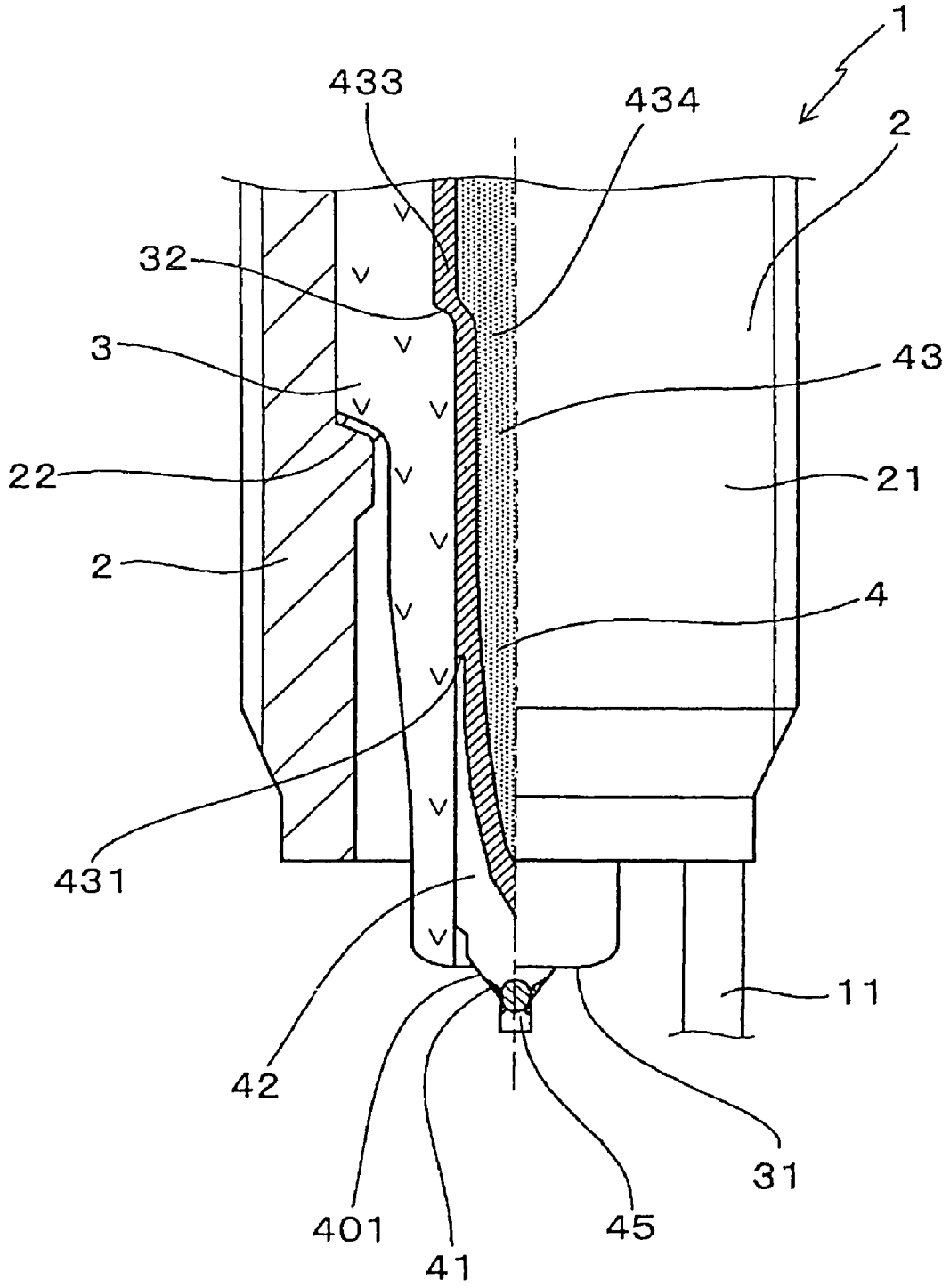
FIG. 5 is a partially longitudinal enlarged sectional view which shows a spark plug according to the third embodiment of the invention.

FIG. 5 shows the spark plug 1 according to the third embodiment of the invention in which the high thermal conductive metal-made portion 43 of the center electrode 4 is made from a composite material containing a combination of Cu and Ni.

The high thermal conductive metal-made portion 43 consists essentially of an outer peripheral portion 433 and a core portion 434 extending inside the outer peripheral portion 433. The outer peripheral portion 433 is made from pure Cu that has a higher thermal conductivity. The core portion 434 is made from pure Ni that has a lower coefficient of thermal expansion. The outer peripheral portion 433 surrounds the whole of the core portion 434 and has a thickness of 0.1 mm to 0.4 mm.

The high thermal conductive metal-made portion 43 is made of a combination of Cu having a higher thermal conductivity and Ni having a lower coefficient of thermal expansion, thus minimizing a defect of the center electrode 4 caused by the thermal expansion thereof and also establishing a high heat range of the spark plug 1.

Other arrangements are identical with those in the first embodiment, and explanation thereof in detail will be omitted here.

We performed tests to evaluate the heat range of the spark plug 1 of the first embodiment. Test results are shown in a graph of FIG. 6.

We first prepared test samples which have the same structure as that of the spark plug 1 of the first embodiment, but are different in the axial distance A between the tip end 31 of the porcelain insulator 3 and the exposed top end 431 of the high thermal conductive metal-made portion 43 in a range of 4 mm to 14 mm and observed times pre-ignitions initiated to occur in the test samples. This was achieved by changing the ignition timing in each of the test samples installed in an automotive internal combustion engine and finding the time when the pre-ignition started to occur. When the pre-ignition has initiated earlier, it means that the degree of dispersal of heat from the porcelain insulator 3 to the plug-mounting shell 2 is higher, that is, the heat range is higher. This is because as the ignition timing causing the pre-ignition is earlier, it results in an increased duration of combustion of the air-fuel mixture, so that the center electrode 4 receives a greater amount of heat and is being subjected to sever environmental conditions.

Figure 6:
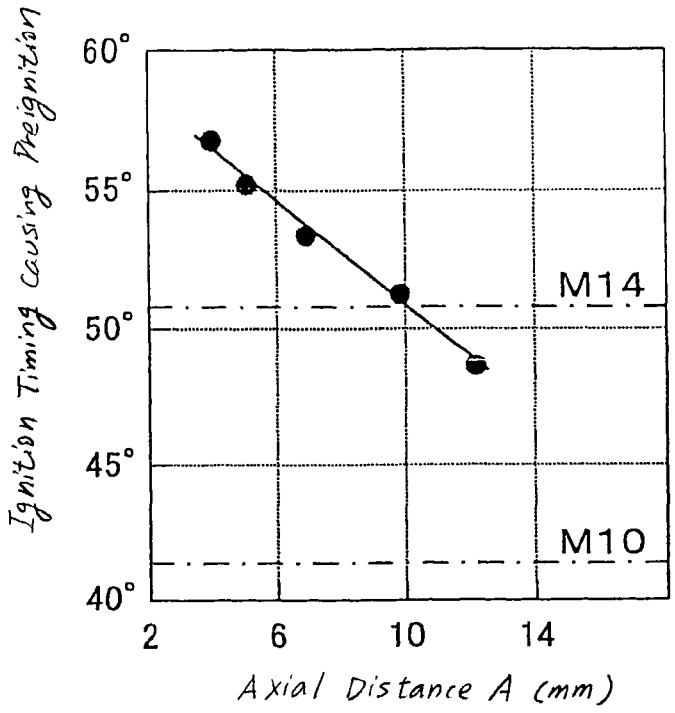
FIG. 6 is a graph which shows experimentally obtained relations between an axial distance A, as indicated in FIG. 1, and the time the pre-ignition starts to occur.

In the graph of FIG. 6, the vertical axis indicates the ignition timing when the pre-ignition started to occur, as expressed by the angular position of the crankshaft of the engine (i.e., crank angle).

The engine, as used in the above tests, was a six-cylinder two-liter engine. The tests were performed by running the engine at full throttle at 5600 rpm and advancing the ignition timing in each of the test samples. The plug-mounting shell 2 of each of the test samples had the thread 21 of diameter M10.

Figure 8:
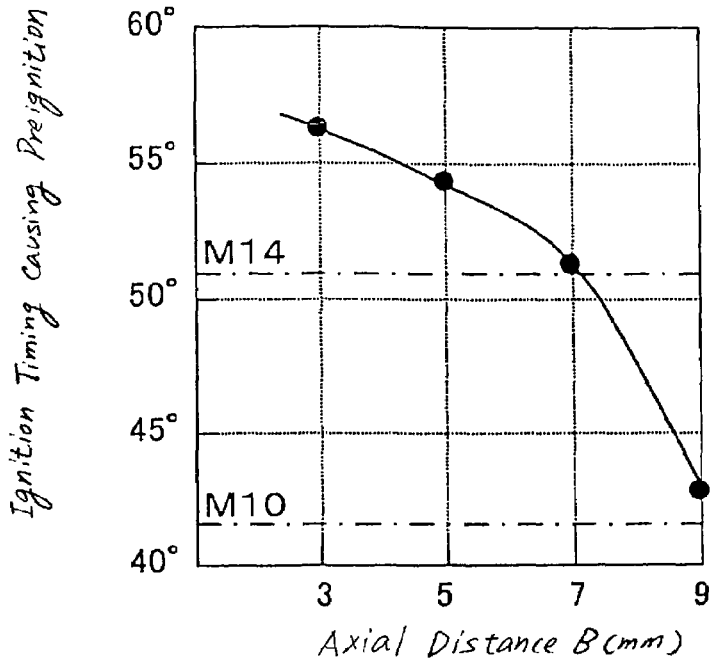
FIG. 8 is a graph which shows experimentally obtained relations between an axial distance B, as indicated in FIG. 4, and the time the pre-ignition starts to occur.
Figure 9:
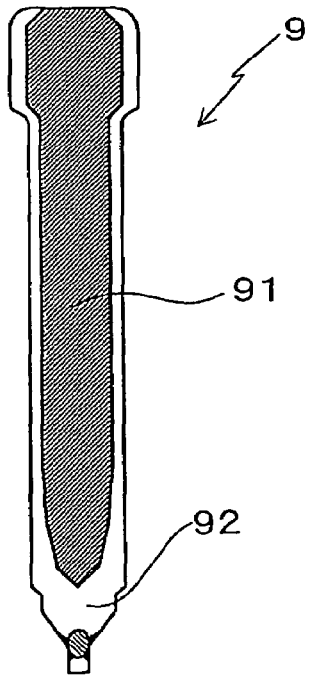
FIG. 9 is a longitudinal sectional view which shows an internal structure of a center electrode disposed in a conventional spark plug.

We also performed the same tests, as described above, on comparative test samples which are, as illustrated in FIG. 9, each equipped with the center electrode 9 made up of the Cu core 91 and the Ni alloy-made outer layer 92 and have threads of M10 and M14. Results of tests are shown in the graph of FIG. 6. "●" indicates each of the test samples having the same structure as that of the spark plug 1. Dashed lines indicate the comparative samples equipped with the threads of M10 and M14, respectively. The same applies to a graph of FIG. 8, as described later.

The graph of FIG. 6 shows that the smaller the axial distance A, the earlier the ignition timing causing the pre-ignition to occur, which provides a higher degree of dispersal of heat from the test samples and that when the axial distance A is 10 mm or less, the degree of heat dispersal in the test samples is higher than that of the comparative test samples having the threads of M14, and the test samples are all higher in degree of heat dispersal than the comparative test samples having the threads of M10 regardless of the axial distance A.

We also prepared test samples which have the same structure as that of the spark plug 1 of the first embodiment and are different in the axial distance A within a range of 4 mm to 14 mm and measured the spark gap G after the durability tests to evaluate the thermal expansion of the center electrode 4.

The durability tests were performed using a six-cylinder two-liter engine running at full throttle at 5600 rpm. The top 41 of the center electrode 4 was elevated up to 900° C.

The plug-mounting shell 2 of each of the test samples had the thread 21 of diameter M10.

Figure 7:
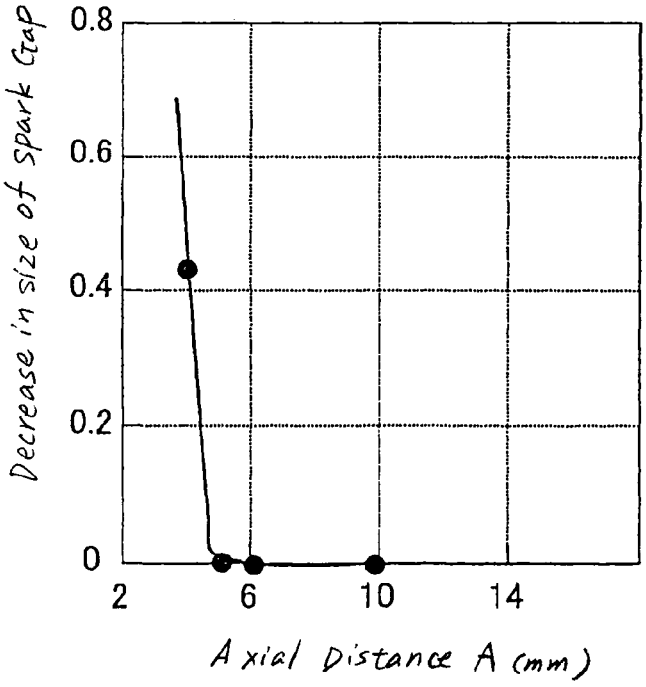
FIG. 7 is a graph which shows experimentally obtained relations between an axial distance B, as indicated in FIG. 4, and a decrease in size of a spark gap.

Test results are indicated by symbols "●" in a graph of FIG. 7. The graph shows that when the axial distance A is 5 mm or more, the spark gap G undergoes no reduction in size.

We also prepared test samples which have the same structure as that of the spark plug 1 of the second embodiment and are different in the axial distance B between the top end 432 of the high thermal conductive metal-made portion 43 and the tip end 31 of the porcelain insulator 3 within a range of 3 mm to 9 mm and observed times pre-ignitions initiated to occur in the test samples to evaluate the heat range. Test results are demonstrated in a graph of FIG. 8.

The graph shows that when the axial distance B is 7 mm or less, the degree of heat dispersal in the test samples is higher than that of the comparative test samples having the threads of M14.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A spark plug for an internal combustion engine comprising:

a plug mounting shell equipped with a thread which is formed on an outer periphery thereof and has a diameter of M12 or less, said mounting shell having an insulator mount portion formed therein;

a porcelain insulator disposed inside said mounting shell so as to have a tip end protruding from said mounting shell, said porcelain insulator having a mount portion bearing on the insulator mount portion of said mounting shell;

a ground electrode; and a center electrode defining a spark gap between itself and said ground electrode, said center electrode being retained inside said porcelain insulator so as to have a top portion exposed outside said porcelain insulator and including an oxidation resistant alloy-made portion and a thermal conductive metal-made portion, the oxidation resistant alloy-made portion being made from material containing a main component of Ni and an additive of at least one of Cr and Al, the oxidation resistant alloy-made portion occupying at least the top portion of said center electrode, the thermal conductive metal-made portion being made of one of Cu, Cu alloy, Ni, and a composite material containing at least two of Cu, Cu alloy, and Ni, the thermal conductive metal-made portion defining a portion of an outer periphery of said center electrode which faces the insulator mount portion of said mounting shell through said porcelain insulator in a directoion perpendicular to an axial direction of said center electrode.

2. A spark plug as set forth in claim 1, wherein said porcelain insulator has a base end opposite the tip end in a lengthwise direction thereof, said porcelain insulator having formed therein an electrode mount portion which bears said center electrode, the electrode mount portion being located closer to the base end than the insulator mount portion of said mounting shell.

3. A spark plug as set forth in claim 2, wherein the thermal conductive alloy-made portion defines a portion of the outer periphery of said center electrode in a range extending from a portion of said center electrode located 5 mm to 10 mm away from a tip end of the top portion of said center electrode to a base end of said center electrode opposite the tip end in a lengthwise direction of said center electrode.

4. A spark plug as set forth in claim 1, wherein said porcelain insulator has formed therein an electrode mount portion which bears said center electrode, the electrode mount portion being located closer to the tip end of said porcelain insulator than the insulator mount portion of said mounting shell.

5. A spark plug as set forth in claim 4, wherein the thermal conductive metal-made portion of said center electrode has a top end located 2 mm to 7 mm away from the tip end of said porcelain insulator.

6. A spark plug as set forth in claim 1, wherein said insulator mount portion of said mounting shell comprises an annular shoulder seat and wherein said mount portion of said porcelain insulator bears on said shoulder seat.

7. A spark plug as set forth in claim 6, wherein said mount portion of said porcelain insulator comprises an annular shoulder formed on an outer periphery of the porcelain insulator, and wherein said annular shoulder is seated on the shoulder seat of the mounting shell through an annular gasket.

8. A spark plug as set forth in claim 2, wherein said electrode mount portion which bears said center electrode comprises an annular shoulder seat.

9. A spark plug as set forth in claim 8, wherein the center electrode has an annular shoulder formed on an outer periphery thereof which is seated on the shoulder seat of the porcelain insulator.

10. A spark plug as set forth in claim 4, wherein said electrode mount portion which bears said center electrode comprises an annular shoulder seat.

11. A spark plug as set forth in claim 10, wherein the center electrode has an annular shoulder formed on an outer periphery thereof which is seated on the shoulder seat of the porcelain insulator.

* * * * *